US006094041A

United States Patent [19]

Wachter

[11] Patent Number: 6,094,041

[45] Date of Patent: Jul. 25, 2000

[54] TEMPERATURE STABILIZED REFERENCE VOLTAGE CIRCUIT THAT CAN CHANGE THE CURRENT FLOWING THROUGH A TRANSISTOR USED TO FORM A DIFFERENCE VOLTAGE

[75] Inventor: Franz Wachter, Villach, Austria

[73] Assignee: Siemens Aktiengesellschaft, Munich, Germany

[21] Appl. No.: 09/296,123

[22] Filed: Apr. 21, 1999

[30] Foreign Application Priority Data

Apr. 21, 1998 [DE] Germany ..... 198 17 791

[51] Int. Cl.[7] ..... G05F 3/16

[52] U.S. Cl. ..... 323/315; 323/314

[58] Field of Search ..... 323/314, 315

[56] References Cited

U.S. PATENT DOCUMENTS 5,247,241 9/1993 Ueda ..... 323/312

*Primary Examiner*—Shawn Riley

*Attorney, Agent, or Firm*—Herbert L. Lerner; Laurence A. Greenberg; Werner H. Stemer

[57] ABSTRACT

A reference voltage circuit has a bipolar transistor circuit supplying a reference voltage corresponding to a summation voltage formed from a forward voltage of a pn junction through which current flows, and a difference voltage between two forward voltages of pn junctions which are operated with different current densities. The reference voltage circuit includes a calibration device that can be used to change collector currents of the bipolar transistor circuit. This is achieved, in particular, by corrupting the mirroring ratio of a current mirror circuit provided for the bipolar transistor circuit.

20 Claims, 4 Drawing Sheets

TEMPERATURE STABILIZED REFERENCE VOLTAGE CIRCUIT THAT CAN CHANGE THE CURRENT FLOWING THROUGH A TRANSISTOR USED TO FORM A DIFFERENCE VOLTAGE

BACKGROUND OF THE INVENTION

Field of the Invention

The present invention relates to a reference voltage circuit which supplies a reference voltage that can be calibrated by a calibrating device.

Integrated circuits that are not operated from a stabilized supply voltage require a reference voltage source internally. This applies, in particular, to voltage regulators whose output voltage serves as a reference voltage for other integrated circuits or circuit blocks.

In principle, the on-state or forward voltage of a diode or generally of a pn junction, e.g. the base-emitter voltage of a bipolar transistor, can be used as a reference voltage. However, the forward voltage of a pn junction has a negative temperature coefficient, which has an adverse effect for many applications. If, by way of example, it is intended to supply sensors, A/D converters or similar components with the aid of a voltage regulator whose output voltage serves as a reference voltage, the output voltage of the voltage regulator must be highly accurate and, in particular, extremely stable with regard to temperature.

Therefore, band-gap reference voltage circuits are preferably used as reference voltage sources that supply a temperature-stabilized reference voltage. These known band-gap reference voltage sources are based on addition of a forward voltage of a pn junction through which current flows, and a difference voltage multiplied by a corresponding factor, which difference voltage is formed from two voltages of two pn junctions through which different current densities flow. Generally, the forward voltage of a pn junction through which current flows has a negative temperature coefficient as has already been explained above. On the other hand, the difference between two forward voltages rises proportionally to the absolute temperature and is thus subject to a positive temperature coefficient. If the factor by which the difference voltage explained above is multiplied is set in such a way that the negative temperature coefficient of the forward voltage of the pn junction and the positive temperature coefficient of the difference voltage cancel each other out, it is possible to obtain a temperature-stabilized output or reference voltage. In particular, the output voltage of such a reference voltage source, which is obtained by addition of the above-explained forward voltage of a pn junction through which current flows, to the difference voltage (likewise explained above), amounts to approximately 1.25 V, which corresponds approximately to the band-gap of silicon. Therefore, such reference voltage sources are referred to as band-gap reference voltage sources.

SUMMARY OF THE INVENTION

With the foregoing and other objects in view there is provided a reference voltage circuit that includes a bipolar transistor circuit with a plurality of bipolar transistors. The bipolar transistor circuit supplies a reference voltage derived from a summation voltage formed from a first voltage and a second voltage. The first voltage is derived from a forward voltage of a pn junction through which current flows. The second voltage is derived from a difference voltage between two forward voltages of corresponding pn junctions through which current flows. A calibrator is provided for calibrating the reference voltage supplied by the bipolar transistor circuit. The calibrator is configured such that, upon a corresponding activation, the calibrator changes a collector current of at least one of the bipolar transistors of the bipolar transistor circuit.

According to the present invention, the reference voltage circuit is calibrated by changing the collector current of at least one bipolar transistor of the circuit section that supplies the reference voltage. If the collector currents of the two bipolar transistors of the circuit section which supplies the reference voltage are changed, the output voltage of the reference voltage circuit can be adjusted, proceeding from a preset value, both upward and downward.

In accordance with the preferred exemplary embodiment of the present invention, the calibration is effected, in particular, by distorting, that is to say corrupting, the conversion ratio of the current mirror of the reference voltage circuit. Controllable switches, in particular in the form of MOS field-effect transistors, can be activated by the application of corresponding calibration voltages to calibration terminals of the reference voltage circuit, with the result that, when the switches are in the closed state, a specific current is tapped from the collector current paths between the current mirror and the two bipolar transistors. In particular, the reference voltage circuit includes a plurality of calibration terminals which are connected to controllable switches in such a way that when a calibration voltage is applied to the individual calibration terminals, different currents are tapped from the above-mentioned collector current paths, with the result that different settings of the reference voltage are possible by activating different terminals.

Measurements on the silicon carried out on a test circuit according to the invention have yielded, by way of example, a temperature response of the reference voltage supplied by the reference voltage circuit of +/−0.72% in the temperature range from −40° C. to +225° C., and it was possible to carry out calibration of the reference voltage as desired in a range of +/−3%. If a basic accuracy after the calibration of +/−0.5% is assumed, the total error to be expected during production in the above-described temperature range is less than +/−1.5%.

Consequently, the calibratable reference voltage source of the present invention is particularly suitable for high-temperature applications of integrated circuits, such as e.g. for integrated voltage regulators, A/D converters or measuring circuits produced with the aid of BICMOS processes. Since the present invention enables all of the leakage currents to be corrected with the aid of a low outlay on circuitry, it is possible to provide the desired band-gap reference voltage with high accuracy and temperature stability even at operating temperatures of up to 250° C.

Other features which are considered as characteristic for the invention are set forth in the appended claims.

Although the invention is illustrated and described herein as embodied in a reference voltage circuit, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 2:
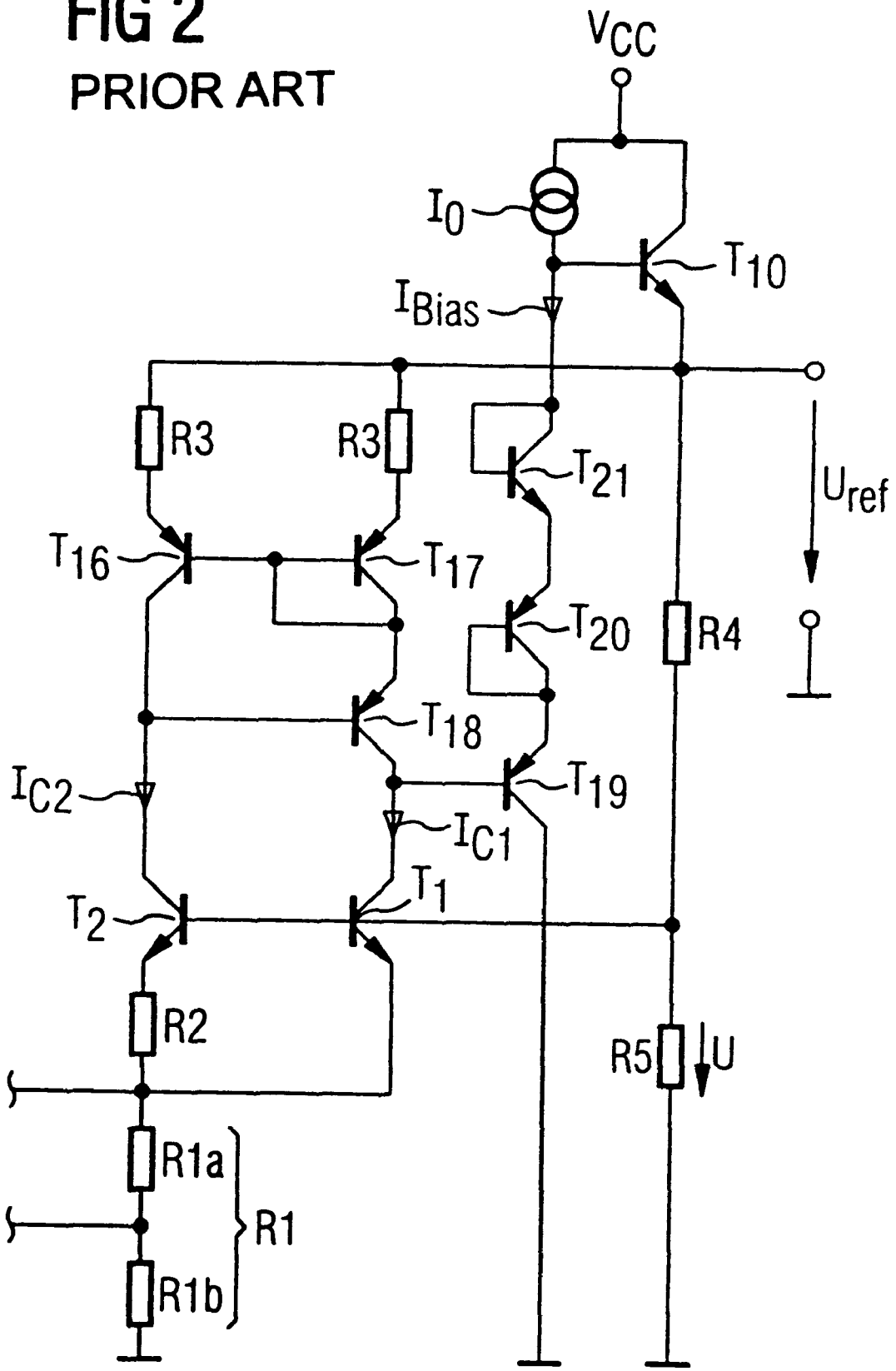
FIG 2 PRIOR ART
FIG. 2 is a circuit diagram of a prior art reference voltage circuit.

In all the figures of the drawing, sub-features and integral parts that correspond to one another bear the same reference symbol in each case. Referring now to the figures of the drawing in detail and first, particularly, to FIG. 2 thereof, there is shown a generalized circuit diagram of a known band-gap reference voltage source. A current mirror circuit is connected to a positive supply voltage terminal $V_{cc}$ via a current source $I_0$, which supplies an impressed current $I_{Bias}$. The current mirror circuit contains two resistors R3 and also bipolar transistors T16–T21. The current mirror circuit generates output currents $I_{c1}$ and $I_{c2}$, which are fed to the npn bipolar transistors T1 and T2, respectively, which are connected up as shown in FIG. 2. Base terminals of the two transistors T1 and T2 are connected to one another. A base voltage U of the transistor T1 is multiplied by a voltage divider containing two resistors R5 and R4, with the result that a desired output or reference voltage $U_{ref}$ can be picked off at the resistor R4. A transistor T10 is coupled to the output terminal of the reference voltage circuit and has the task of regulating the output voltage $U_{ref}$ to a constant value if the output of the band-gap reference voltage source shown in FIG. 2 is loaded by a non-uniform load. Instead of the transistor T10, it is possible to use any desired actuator, for example an operational amplifier or a MOS field-effect transistor, which can undertake the regulating task explained above.

With the aid of the current mirror T16–T21 shown in FIG. 2, the currents respectively flowing through the transistors T1 and T2 are set, the currents $I_{c1}$ and $I_{c2}$ usually having the same magnitude. In BICMOS or BICDMOS circuits, however, the current $I_{c1}$ is frequently also set to a multiple value of the current $I_{T2}$. The transistors T1 and T2 have different emitter areas. The emitter area of the transistor T2 corresponds to a multiple of the emitter area of the transistor T1, with the result that, accordingly, the emitter current density of the transistor T1 corresponds to a multiple of the emitter current density of the transistor T2.

The summation voltage formed from the base-emitter voltage of the transistor T1 and also the voltage present at a node between resistors R1 (containing the resistor elements R1*a* and R1*b*) and R2 is picked off at the common base terminal of the transistors T1 and T2. The first-mentioned base-emitter voltage of the transistor T1 corresponds to the forward voltage of a pn junction through which current flows, and therefore has, as was explained above, a negative temperature coefficient. The voltage drop across the resistor R1 or across the resistors R1*a* and R1*b* is dependent on the difference between the base-emitter voltage of the transistor T1 and the base-emitter voltage of the transistor T2 and has, as was likewise explained above, a positive temperature coefficient. By a corresponding selection of the resistors R1 and R2 and also of the above-specified relationship between the emitter areas of the transistors T1 and T2, it is possible to dimension the band-gap reference voltage source shown in FIG. 2 in such a way that the difference voltage formed from the forward voltages of the two transistors T1 and T2 and present across the resistor R1 is subject to a positive temperature coefficient which compensates for the negative temperature coefficient. In this case, the desired temperature-stabilized band-gap reference voltage of approximately 1.25 V is present at the common base terminal of the transistors T1 and T2 and is multiplied by the divider having the resistors R4 and R5.

Band-gap reference voltage circuits of the type shown in FIG. 2 are used for example in BICDMOS technology (bipolar, C and D-MOS technology) for precise voltage regulators. Such reference voltage circuits are specified to a relative error of at most +/−1% in the temperature range from −40° C. to 150° C., with the result that appropriate calibration of the reference voltage circuit has to be provided. In order to minimize production tolerances in this case, each system is individually calibrated to the desired voltage value during production.

Reference voltage circuits of the type shown in FIG. 2 are frequently used on chips that also contain power switches in addition to normal switched-mode regulators. This applies particularly to automobile applications, for example. The power transistors are monitored by integrated temperature sensors which, for their part, require a voltage reference which is stable with regard to temperature, in order still to be able to switch dynamically in a reliable manner in the desired high-temperature range of 250° C. (transistor core temperature). If the thermal gradient on the chip used in each case is taken into account, it may be assumed that the band-gap reference voltage circuit used must be functional, with the greatest possible temperature stability, up to a temperature of 200° C. or, in the extended temperature range, must not exceed a relative error of at most +/−2.5%.

However, that is counteracted by thermal depletion-layer leakage currents that commence from approximately 140° C. and increase exponentially as the temperature rises. Therefore, there is a need to minimize the influence of the thermal depletion-layer leakage currents on the reference voltage supplied by the reference voltage circuit. As has already been explained above, possibilities for calibrating the output voltage of the reference voltage circuit are generally provided. In such calibration circuits, however, leakage currents likewise occur and usually have a major influence on the temperature stability of the reference voltage circuit, in particular at high temperatures. This will be explained in more detail below with reference to FIG. 3.

Figure 3:
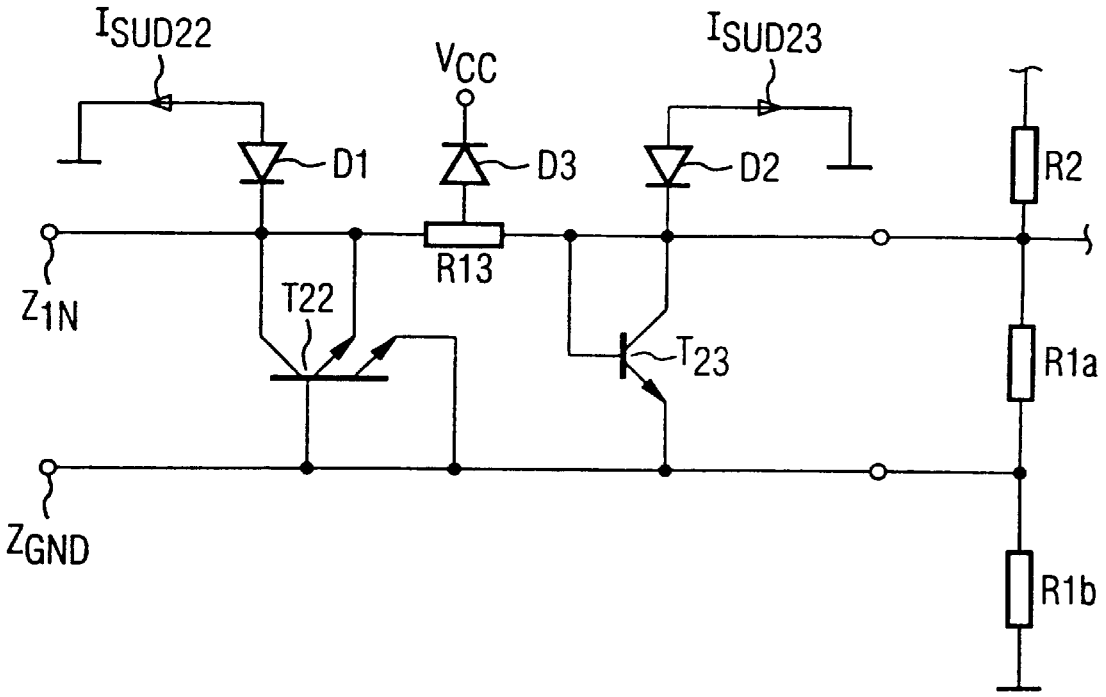
FIG 3 PRIOR ART
FIG. 3 is a circuit diagram of a prior art calibration circuit that is used to calibrate the reference voltage circuit shown in FIG. 2.

The reference voltage supplied by the reference voltage source is usually calibrated by changing over the divider ratio R1:R2 shown in FIG. 2, which can be realized by resistors which are to be connected in parallel in a corresponding manner. FIG. 3 illustrates, by way of example, a corresponding calibration circuit connected to the resistors R1*a* and R1*b* shown in FIG. 2, so-called "zapping" diodes being used as calibration switches, which diodes break down upon application of a high external voltage in the reverse direction and produce a low-impedance connection. FIG. 3 illustrates such a "zapping" diode in the form of an npn bipolar transistor T22, which can be made to break down in the reverse direction by the application of a correspondingly high calibration voltage to the terminals $Z_{1N}$ and $Z_{GND}$. In this case, the resistor R1*a* is short-circuited owing to the breakdown of the diode formed in the bipolar transistor T22 and, consequently, the total resistance of the resistor R1, which contains the resistors R1*a* and R1*b* according to FIGS. 2 and 3, is changed. The change in the divider ratio of the resistors R1 and R2 has a direct effect on the difference voltage between the base-emitter voltages of the bipolar transistors T1 and T2 which is present at the node between the resistors R1 and R2 (cf. FIG. 2), with the result that, by virtue of a corresponding change in the divider ratio R1:R2, the voltage present at the base of the transistor T1 and thus the reference voltage $U_{ref}$ output by the reference voltage source can be set or calibrated.

Since the transistor T22 forming the "zapping" diode has a depletion layer with respect to the substrate (depletion-layer isolation), the depletion layer being indicated by a diode D1 in FIG. 3, collector-substrate leakage currents $I_{sud22}$ (or collector-base leakage currents in the case of diodes which are not short-circuited after the calibration) occur particularly at high temperatures, and corrupt the divider ratio R1:R2 and thus the output voltage $U_{ref}$. Furthermore, such calibration circuits require voltage clamping circuits in order to protect the circuit against the high voltages that occur during calibration at the calibration terminals. Such a voltage clamping circuit is represented in FIG. 3 by a diode D3, a transistor T23 and a resistor R13. The collector of the transistor T23 also has a depletion layer with respect to the substrate. The depletion layer is indicated by a diode D2 in FIG. 3, with the result that, with regard to the transistor T23 as well, collector-substrate leakage currents $I_{sud23}$ occur particularly at high temperatures, in other words the leakage current effect described above is even further intensified by the voltage clamping circuit provided for the purpose of protecting the calibration circuit against the high calibration voltages.

Consequently, the circuit shown in FIG. 3 can no longer be operated with the requisite accuracy from temperatures of approximately 160° C. and above. A further disadvantage of the circuit is the finite resistance of the "zapping" diode after the breakdown thereof, since this resistance is connected serially with respect to the actual calibration resistor and, consequently, likewise corrupts the output voltage in an undesirable manner.

The principle for obtaining the reference voltage as explained with reference to FIG. 2 continues to be employed in the invention of the instant application, that is to say the reference voltage is obtained by the addition of a forward voltage of a pn junction through which current flows, to a difference voltage between two different forward voltages of corresponding pn junctions through which the current flows. In particular, two bipolar transistors T1 and T2 continue to be used, in accordance with FIG. 2, in the voltage section that generates the reference voltage, specific collector currents $I_{c1}$ and $I_{c2}$ respectively being fed to the collectors of the bipolar transistors. The base terminals of the two transistors are connected to one another, while the emitters of the two transistors are coupled to one another via a resistor circuit (cf. FIG. 2). As has already been explained with reference to FIG. 2, the reference voltage is picked off at the common base terminal of the bipolar transistors T1 and T2 and, if appropriate, multiplied by a voltage divider. The voltage applied to the base of the bipolar transistor T1 is composed of the base-emitter voltage of the bipolar transistor T1 and the voltage present at the node between the resistors R1 and R2. The last-mentioned voltage is dependent on the difference voltage between the base-emitter voltages of the two bipolar transistors T1 and T2. The result that can be achieved by suitable dimensioning of the voltage reference circuit is that the positive temperature coefficient of the difference voltage corresponds to the negative temperature coefficient of the base-emitter voltage of the bipolar transistor T1, so that the desired temperature-stabilized band-gap reference voltage of approximately 1.25 V can be picked off at the common base of the bipolar transistors T1 and T2.

As has already been explained with reference to FIG. 2, the bipolar transistors T1 and T2 are operated with different current densities. In particular, the emitter area $A_{E2}$ of the bipolar transistor T2 corresponds to a multiple of the emitter area $A_{E1}$ of the bipolar transistor T1. Likewise, the collector current $I_{c1}$ of the bipolar transistor T1 generally corresponds to a multiple of the collector current $I_{c2}$ of the bipolar transistor T2.

Under the above mentioned assumptions, the voltage U picked off at the common base of the bipolar transistors T1 and T2 in the known reference voltage circuit shown in FIG. 2 can generally be calculated depending on the resistance ratio R1:R2, the collector current ratio $I_{c1}:I_{c2}$ and the emitter area ratio $A_{E2}:A_{E1}$ as follows:

$$U = U_T \frac{R_1}{R_2}\left(1 + \frac{I_{C1}}{I_{C2}}\right)\ln\frac{I_{C1}A_{E2}}{I_{C2}A_{E1}} + U_T \ln\frac{I_{C1}}{I_S}$$

In this case, $U_T$ designates the voltage equivalent of thermal energy and $I_S$ designates the reverse current of the bipolar transistors. As is evident from the above equation, the reference voltage can also be calibrated by changing the collector current ratio $I_{c1}:I_{c2}$. If it is assumed that the collector current $I_{c1}$ is changed proceeding from a preset value $I_{c1'}$, the following is produced:

$$I_{c1}=I_{c1'}(1+k)$$

For small calibration steps ($k \leqq 6\%$), it is possible, with quadratic terms being left out and with the simplification $\ln(1+k)=k$ being used, to effect rewriting to produce the following:

$$U = U'\left(1 + \frac{U_T}{U'}\left(1 + \frac{R_1}{R_2}\left(1 + \frac{I'_{C1}}{I_{C2}}\left(1 + \ln\frac{I'_{C1}A_{E2}}{I_{C2}A_{E1}}\right)\right)\right)\right)$$

where U' designates the original, i.e. preset, reference voltage and can be represented by the following expression:

$$U' = U_T \frac{R_1}{R_2}\left(1 + \frac{I'_{C1}}{I_{C2}}\right)\ln\frac{I'_{C1}A_{E2}}{I_{C2}A_{E1}} + U_T \ln\frac{I'_{C1}}{I_S}$$

Consequently, the following linear relationship holds true:

$$U=U'(1+kC),$$

where the constant C can be expressed by $$C = \frac{U_T}{U'}\left(1 + \frac{R_1}{R_2}\left(1 + \frac{I'_{C1}}{I_{C2}}\left(1 + \ln\frac{I'_{C1}A_{E2}}{I_{C2}A_{E1}}\right)\right)\right)$$

The constant C assumes a value of about C=0.5 in the case of the presently realized circuit at room temperature. In order to change the output voltage U by 3%, it will be necessary, accordingly, to change the collector current $I_{c1}$ of the bipolar transistor T1 by 6%.

What is evident overall from the above explanations is that the reference voltage supplied by the reference voltage circuit can be calibrated by changing the collector current ratio $I_{c1}:I_{c2}$. The present invention utilizes this insight.

Figure 1A:
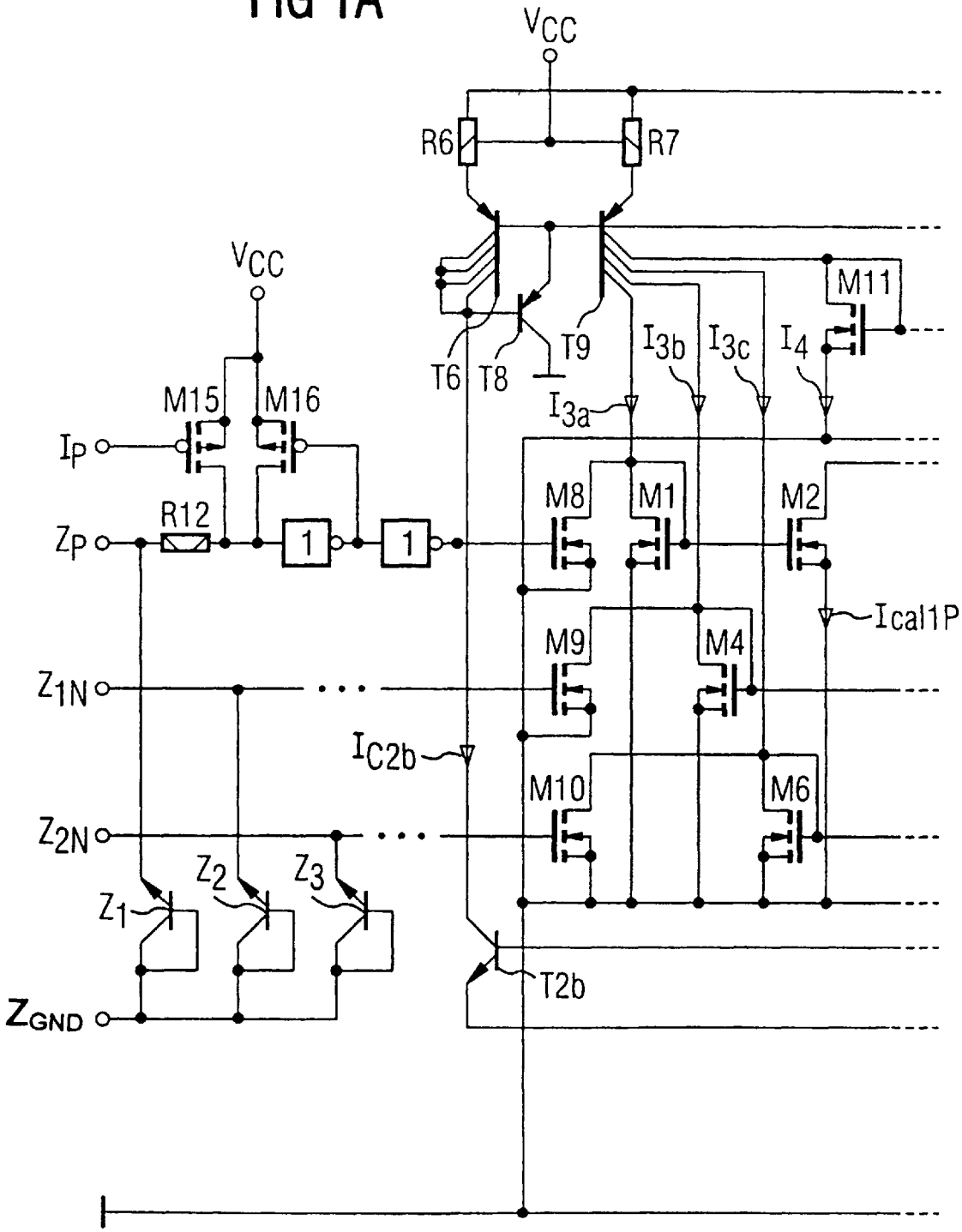
FIGS. 1*a* and 1*b* are diagrammatic circuit diagrams of a preferred exemplary embodiment of a reference voltage circuit according to the invention.
Figure 1B:
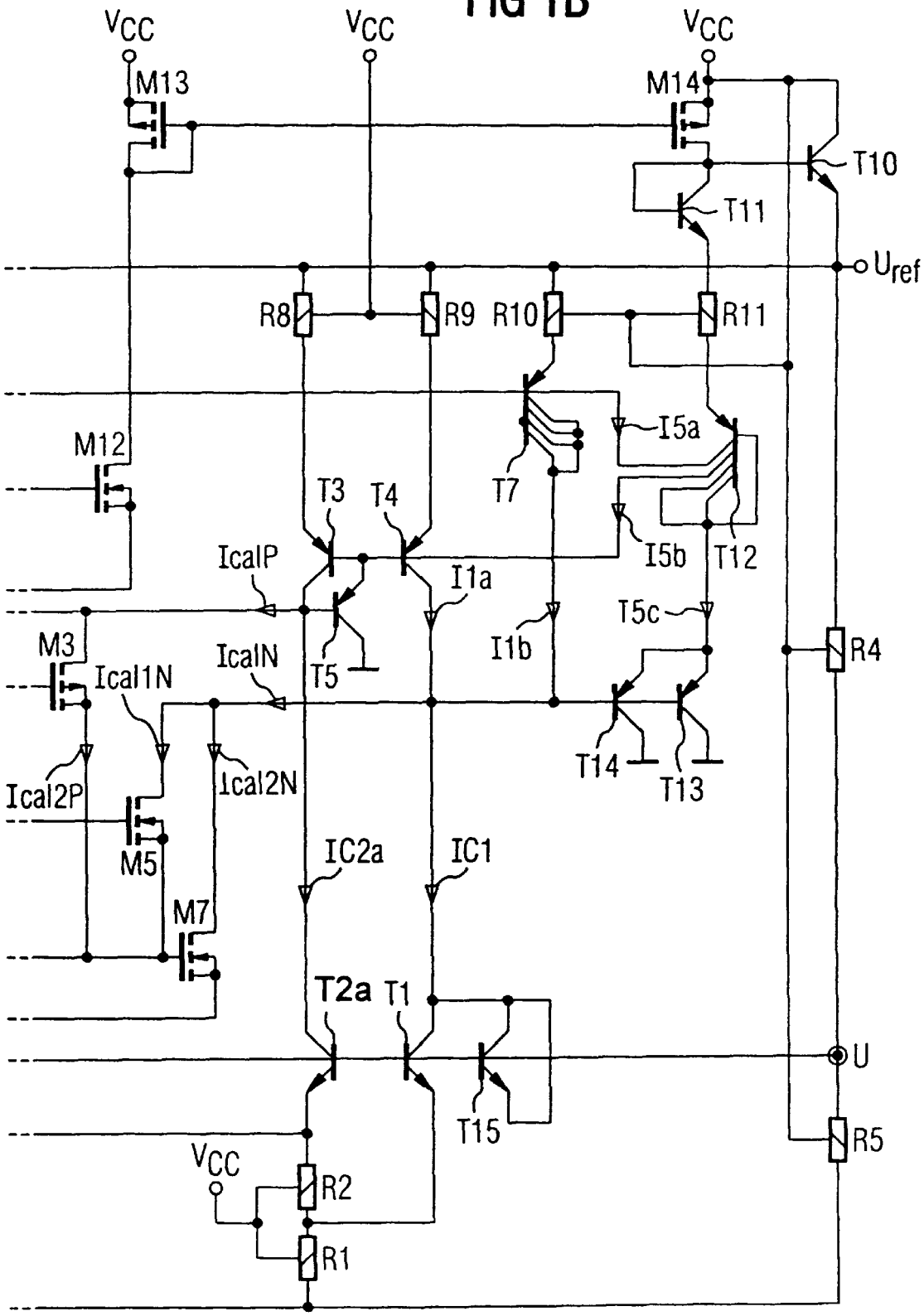

FIGS. 1*a* and 1*b* show a detailed circuit diagram of a preferred exemplary embodiment of the reference voltage circuit according to the invention, in which, by external trimming measures, the ratio of the current mirror used in this case is distorted in order to change the collector current ratio $I_{c1}:I_{c2}$. In particular, FIGS. 1*a* and 1*b* illustrate a reference voltage circuit implemented in automobile applications (e.g. an airbag).

A pair of transistors T1 and T2*a* coupled to one another is also present in the reference voltage circuit shown in FIG. 1*b,* the emitter area of the transistor T2*a* being a multiple of the emitter area of the transistor T1. Collector currents $I_{c1}$ and $I_{c2a}$ respectively are fed to the collectors of the transistors. The emitters of the two bipolar transistors are coupled to one another via a resistor circuit having the resistors R1 and R2. The base voltage applied to the common base of the bipolar transistors T1 and T2*a* is picked off and multiplied up by a voltage divider containing the resistors R4 and R5, with the result that the desired output or the reference voltage $U_{ref}$ can be output depending on the base voltage U. The voltage applied to the common base of the bipolar transistors T1 and T2*a,* which are operated with different current densities, corresponds to the summation voltage formed from the base-emitter voltage of the transistor T1 and the voltage which is present at the node between the resistors R1 and R2 and is once again dependent on the difference between the base-emitter voltage of the transistor T1 and the base-emitter voltage of the transistor T2*a*.

Furthermore, the operating currents of the reference voltage circuit can be set by the resistors R1 and R2. As a result of the base voltage U of the bipolar transistor T1 being multiplied up or increased with the aid of the voltage divider R4, R5, the reference voltage circuit is able to feed itself and the supply voltage punch-through becomes negligible. Overall, the method of operation of the reference voltage circuit shown in FIG. 1*b* corresponds in this respect to the method of operation of the known reference voltage circuit shown in FIG. 2.

As has already been explained, however, according to the present invention at least one of the collector currents $I_{c1}$ and/or $I_{c2a}$ is changed so that the reference voltage $U_{ref}$ supplied by the reference voltage circuit can be calibrated in a desired manner. This is done, in particular, by changing the mirroring or conversion ratio of the current mirror that is also used in the known reference voltage circuit of FIG. 2.

According to FIGS. 1*a* and 1*b,* however, two current mirror circuits are present. The first current mirror contains bipolar transistors T3–T5 and essentially corresponds to the current mirror used in FIG. 2. The second current mirror contains bipolar transistors T6–T8. Moreover, a further bipolar transistor T2*b* is provided, which is configured, in particular, to be structurally identical to the bipolar transistor T2*a*. The current mirrors having the bipolar transistors T3–T5 and T6–T8 are disposed in such a way that they are connected in parallel with one another via the multiple transistors T2*a* and T2*b*. The emitter areas of the two transistors T2*a* and T2*b* are equal in size, with the result that the basic currents $I_{c2a}$ and $I_{c2b}$ respectively supplied by the two current mirrors are identical.

In accordance with the configuration shown in FIGS. 1*a* and 1*b,* the mirroring ratio of the second current mirror having the transistors T6–T8 remains constant even during the calibration of the reference voltage circuit, that is to say only the mirroring ratio of the first current mirror circuit having the bipolar transistors T3–T5 is effected by a corresponding calibration. This is carried out as follows.

The output voltage $U_{ref}$ present at the output terminal of the reference voltage circuit can be calibrated via calibration terminals $Z_P$, $Z_{1N}$ and $Z_{2N}$. For this purpose, use is once again made of "zapping" diodes Z1–Z3 which are formed by the bipolar transistors (shown in FIG. 1*a*) having a short-circuited base-collector junction and respectively connect one of the calibration terminals $Z_P$, $Z_{1N}$ and $Z_{2N}$ to the calibration ground terminal $Z_{GND}$. Applying a specific high calibration voltage to one of the calibration terminals causes the corresponding "zapping" diode to break down, with the result that a low-impedance connection is produced between the base and the emitter of the corresponding "zapping" diode, which connection results in corresponding activation of controllable switches (shown in FIG. 1*a*) in the form of p-channel MOS field-effect transistors. In this case, according to FIGS. 1*a* and 1*b,* the MOS field-effect transistors M1–M3 and M8, for example, are assigned to the calibration terminal $Z_P$. When the required high calibration voltage is applied to a specific one of the calibration terminals, the MOS field-effect transistors assigned to the calibration terminal are switched by the low-impedance connection of the respective "zapping" diode, the connection corresponding to the respective calibration terminal, in such a way that a specific quantity of current assigned to the respective calibration terminal is tapped from the collector current paths of the bipolar transistors T1 or T2*a* in the form of the calibration currents IcalP and IcalN shown in FIGS. 1*a* and 1*b,* which results in corresponding corruption of the mirroring ratio of the current mirror having the bipolar transistors T3–T5, so that the reference voltage circuit can be calibrated within specific limits in order to obtain a desired output voltage $U_{ref}$.

The reference voltage circuit shown in FIGS. 1*a* and 1*b* is dimensioned, in particular, in such a way that an increase in the output voltage $U_{ref}$ can be obtained by applying a calibration voltage to the calibration terminal $Z_P$, while a reduction in the output voltage $U_{ref}$ by different magnitudes can be brought about by applying a calibration voltage to the calibration terminals $Z_{1N}$ and/or $Z_{2N}$. In particular, the reference voltage circuit shown in FIGS. 1*a* and 1*b* is dimensioned in such a way that the output voltage can be changed within a maximum calibration range of +3%. As can be inferred from the above-described formula for the constant C, such a change in the output voltage necessitates a change in the collector current $I_{c1}$ of the bipolar transistor T1 by 6%. In particular, the reference voltage circuit shown in FIGS. 1*a* and 1*b* is dimensioned in such a way that an increase in the reference voltage $U_{ref}$ by +3% is obtained by applying a high calibration voltage between the terminals $Z_P$ and $Z_{GND}$. By contrast, the calibration step that can be obtained via the calibration terminal $Z_{1N}$ is −1% and the calibration step that can be obtained via the calibration terminal $Z_{2N}$ is −2%. In this way, additive calibration of the output voltage $U_{ref}$ between −3% and +3% in 1% steps is possible by, if appropriate, jointly activating the calibration terminals $Z_P$, $Z_{1N}$ and $Z_{2N}$.

In FIG. 1*a* , the calibration terminal $Z_P$ is connected to the first controllable MOS field-effect transistor M8 via a control circuit containing a resistor R12, two p-channel MOS field-effect transistors M15 and M16 and also two inverters. This control circuit can be activated via a terminal $I_P$ and connects the gate terminal of the MOS field-effect transistor M8 to the "zapping" diode Z1 in a predefined manner. Corresponding control circuits are also provided for the further calibration terminals $Z_{1N}$ and $Z_{2N}$, but are not illustrated in FIG. 1*a* for the sake of clarity.

Upon activation of the calibration terminal $Z_P$, on account of a breakdown of the "zapping" diode Z1, the MOS field-effect transistor M8 is turned on and a specific current $I_{3a}$ is coupled out from the second current mirror (bipolar transistors T6–T8) via a further bipolar transistor T9. The coupled-out current $I_{3a}$ is fed to the MOS field-effect transistors M1–M3 and results in a specific calibration current IcalP being tapped from the collector current path of the bipolar transistor T2*a*. The calibration current is divided between the two MOS field-effect transistors M2 and M3 in the form of the currents Ical1P and Ical2P shown in FIGS. 1*a* and 1*b*. In this way, the mirroring ratio of the current mirror having the bipolar transistors T3–T5 is distorted in a defined manner and the current density of the bipolar transistor T2*a* is reduced. This correspondingly results in an increase in the difference voltage picked off at the node between the resistors R1 and R2, so that the desired 3% increase in the output voltage $U_{ref}$ can be achieved.

In an analogous manner, applying a corresponding calibration voltage to the calibration terminals $Z_{1N}$ and $Z_{2N}$ enables a predefined current I3*b* and I3*c*, respectively, to be coupled out via the transistor T9 and fed to the MOS field-effect transistors M4 and M5, and respectively M6 and M7, with the result that a predefined calibration current IcalN is in this case tapped, however, from the collector current path of the bipolar transistor T1. The calibration current IcalN is passed away, in the form of the respective currents Ical1N and Ical2N shown in FIGS. 1*a* and 1*b*, via the correspondingly turned-on MOS field-effect transistors M5 and M7, respectively, and leads to a defined reduction in the collector current density of the bipolar transistor T1, with the result that the difference voltage present at the node between the resistors R1 and R2 is correspondingly reduced, which results in an again corresponding reduction in the reference voltage $U_{ref}$ output at the output terminal of the reference voltage circuit.

On the other hand, with the aid of the MOS field-effect transistors M8–M10, the calibration currents IcalP and IcalN and also the coupled-out currents $I_{3a}$–$I_{3c}$ are switched off if no calibration voltage is applied to one of the terminals $Z_P$, $Z_{1N}$, $Z_{2N}$, so that the influence of the calibration circuit is equal to zero in this case. However, this applies in the high-temperature range only if it is ensured that the drain regions of the MOS field-effect transistors M2 and M3 correspond to those of the MOS field-effect transistors M5 and M7, since, in that case, the thermally induced drain-bulk leakage currents compensate for one another and, in the case of IcalP=IcalN≠0, the output voltage $U_{ref}$ is not influenced. With regard to the linearity of the calibration steps, in particular, it is advantageous to correspondingly dimension the transistors M5 and M2, on the one hand, and also the transistors M7 and M3, on the other hand.

For the reasons mentioned above, according to FIG. 1*b* a dummy transistor T15 is connected to the collector and to the base of the bipolar transistor T1, in which case, however, it is also possible to connect a plurality of dummy transistors T15 connected up in accordance with FIG. 1*b*. It is advantageous for the collector well of the bipolar transistor T1 to be configured to be exactly the same size as that of the multiple transistor T2*a*/*b*, with the result that the increased collector-substrate and/or collector-base generation currents of the larger multiple transistor T2*a*/*b* are compensated for by the transistors T1 and T15.

Moreover, in the preferred exemplary embodiment shown in FIGS. 1*a* and 1*b*, a structurally identical pair of pnp bipolar transistors T13, T14 is provided, with the aid of which the thermal leakage currents of the pnp bipolar transistors T5 and T8 of the two current mirrors are eliminated, the base of the pnp bipolar transistors T5 and T8 in each case corresponding to the epitaxial well. In order also to eliminate the influence of the process-dictated current gain fluctuations by way of the base currents of the pnp bipolar transistors, all of the bipolar transistors are advantageously operated with approximately the same current density by way of the currents $I_{5a}$–$I_{5c}$ shown in FIG. 1*b*. As can be gathered in FIG. 1*b*, the currents $I_{5a}$–$I_{5c}$ are likewise derived from the current $I_{c2b}$ by way of a current $I_4$ by a circuit having p-channel MOS field-effect transistors M11–M14, which automatically effects a suitable setting of the base voltage of the bipolar transistors T13 and T14 with the voltage drops across the components T11, R11 and T12 shown in FIG. 1*b*. Consequently, the collector voltages of the bipolar transistors T4 and T7 are lower by a diode forward voltage than their base voltages, which compensates for the Early effects of the two current mirror circuits at the operating point of the reference voltage circuit. Furthermore, it is possible in this way to avoid any saturation of the pnp bipolar transistors T4 and T7 and also of the npn bipolar transistor T1.

Finally, the n-type epitaxial wells of the individual p-type diffusion resistors are preferably connected to the positive supply voltage $V_{cc}$, in order to prevent the influence, which is not negligible at high temperatures, of the well leakage currents at the base diffusion resistors on the function of the reference voltage circuit.

The resistors R6–R11 additionally illustrated in FIGS. 1*a* and 1*b* serve, in particular, for presetting the two current mirrors, while the bipolar transistor T10 essentially corresponds to the transistor T10 already shown in FIG. 2 and is provided as actuator for the output terminal of the reference voltage circuit in order to regulate the output voltage $U_{ref}$ such that it is constant even in the event of loading with a non-uniform load.

I claim:

1. A reference voltage circuit, comprising:

a bipolar transistor circuit having a plurality of bipolar transistors and supplying a reference voltage derived from a summation voltage formed from a first voltage and a second voltage, the first voltage derived from a forward voltage of a pn junction through which current flows, and the second voltage derived from a difference voltage between two forward voltages of corresponding pn junctions through which current flows; and a calibrator for calibrating the reference voltage supplied by said bipolar transistor circuit, said calibrator configured and disposed such that, upon a corresponding activation, said calibrator changes a collector current of at least one of said bipolar transistors of said bipolar transistor circuit.

2. The reference voltage circuit according to claim 1, wherein said bipolar transistors of said bipolar transistor circuit includes a first bipolar transistor and a second bipolar transistor each having a base, an emitter and a collector, a first collector current fed to said collector of said first bipolar transistor and a second collector current fed to said collector of said second bipolar transistor, said first bipolar transistor and said second bipolar transistor configured in such a way, and the first collector current and the second collector current are dimensioned in such a way, that different current densities flow through said first bipolar transistor and through said second bipolar transistor;

wherein said base of said first bipolar transistor connected to said base of said second bipolar transistor;

including a resistor circuit;

wherein said emitter of said first bipolar transistor coupled to said emitter of said second bipolar transistor via said resistor circuit such that the reference voltage can be picked off at said base of said first bipolar transistor, the first voltage corresponding to a base-emitter voltage of said first bipolar transistor and the second voltage depending on the difference between base-emitter voltages of said first and second bipolar transistors; and wherein said calibrator configured and disposed such that, upon the corresponding activation, said calibrator changes at least one of the first collector current and the second collector current of said first and second bipolar transistors, respectively.

3. The reference voltage circuit according to claim 2, wherein said calibrator is configured and disposed such that, upon the corresponding activation, said calibrator taps at least one of a first calibration current from the first collector current and a second calibration current from the second collector current.

4. The reference voltage circuit according to claim 3, wherein said calibrator includes a control circuit having controllable switches and a plurality of terminals coupled to said collectors of said first and second bipolar transistors via said control circuit, when a corresponding calibration voltage is applied to one of said terminals, one of another first and second calibration current is in each case tapped from one of the first and second collector current.

5. The reference voltage circuit according to claim 4, wherein said plurality of terminals of said calibrator is three terminals including a first terminal, a second terminal and a third terminal, said control circuit constructed such that when a calibration voltage is applied to said first terminal, the second calibration current is tapped from the second collector current and has a magnitude such that the reference voltage is increased by 3%, while when a further calibration voltage is applied to at least one of said second terminal and said third terminal, the first calibration current is tapped from the first collector current and has a magnitude such that the reference voltage decreases by one of 1% and 2%.

6. The reference voltage circuit according to claim 4, wherein said calibrator has diodes coupled to said terminals and break down upon application of the corresponding calibration voltage in a reverse direction and thereby drive corresponding controllable switches of said controllable switches of said control circuit.

7. The reference voltage circuit according to claim 6, wherein said controllable switches are MOS field-effect transistors.

8. The reference voltage circuit according to claim 1, including a current mirror circuit having a translation ratio and generating collector currents for said bipolar transistors of said bipolar transistor circuit, said calibrator disposed and configured such that, upon the corresponding activation, said calibrator changing said translation ratio of said current mirror circuit.

9. The reference voltage circuit according to claim 2, including a current mirror circuit having a translation ratio and generating collector currents including the first collector current and the second collector current for said bipolar transistors of said bipolar transistor circuit, said calibrator disposed and configured such that, upon the corresponding activation, said calibrator changing said translation ratio of said current mirror circuit;

wherein said bipolar transistors of said bipolar transistor circuit includes a third bipolar transistor substantially identical to said second bipolar transistor and having a base, an emitter and a collector; and including a further current mirror circuit coupled to said third bipolar transistor such that said current mirror circuit and said further current mirror circuit are connected in parallel via said second bipolar transistor and said third bipolar transistor, said base and said emitter of said second bipolar transistor connected to said base and to said emitter, respectively, of said third bipolar transistor.

10. The reference voltage circuit according to claim 9, wherein said current mirror circuit and said further current mirror circuit are configured such that the same current density flows through said second and third bipolar transistors.

11. The reference voltage circuit according to claim 9, wherein said calibrator is configured and disposed such that, upon the corresponding activation, said calibrator taps at least one of a first calibration current from the first collector current and a second calibration current from the second collector current;

wherein said calibrator includes a control circuit having controllable switches and a plurality of terminals coupled to said collectors of said first and second bipolar transistors via said control circuit, when a corresponding calibration voltage is applied to one of said terminals, one of another first and second calibration current is in each case tapped from one of the first and second collector current;

wherein said terminals of said calibrator are coupled to said further current mirror circuit via said controllable switches of said control circuit, when the corresponding calibration voltage is applied to one of said terminals, a corresponding controllable switch is activated such that a specific control current corresponding to a respective terminal is tapped off, the specific control current, for leading to activation of a further corresponding controllable switch of said control circuit such that at least one of the first and second calibration current is tapped from at least one of the first and second collector current.

12. The reference voltage circuit according to claim 11, wherein the first calibration current is passed via two of said controllable switches connected in parallel, in which case said two of said controllable switches connected in parallel can be activated by different control currents tapped from said further current mirror circuit.

13. The reference voltage circuit according to claim 12, wherein the second calibration current is passed via two further of said controllable switches connected in parallel, both of said two further of said controllable switches can be activated by the same control current tapped from said further current mirror circuit.

14. The reference voltage circuit according to claim 13, wherein said controllable switches have drain terminals and said drain terminals of said two of said controllable switches connected in parallel and provided for the first calibration current and said two further of said controllable switches connected in parallel and provided for the second calibration current are connected to one another.

15. The reference voltage circuit according to claim 14, wherein one of said two of said controllable switches provided for the first calibration current is identical to one of said two further of said controllable switches provided for the second calibration current.

16. The reference voltage circuit according to claim 9, wherein said bipolar transistors of said bipolar transistor circuit includes a fourth bipolar transistor having a base, an emitter and a collector, said fourth bipolar transistor connected to said base of said first bipolar transistor and said emitter and said collector of said fourth bipolar transistor connected to said collector of said first bipolar transistor.

17. The reference voltage circuit according to claim 9, wherein said first, second and third bipolar transistors each have a collector well that are substantially of the same size.

18. The reference voltage circuit according to claim 9, wherein said current mirror circuit and said further current mirror circuit each have an output, two bipolar transistors coupled to said output, and a pnp bipolar transistor connected to a common base terminal of said two bipolar transistors; and including at least one further pnp bipolar transistor connected in parallel with said pnp bipolar transistor, said current mirror circuit and said further current mirror circuit configured such that said pnp bipolar transistor and said further pnp bipolar transistor are operated with identical current densities.

19. The reference voltage circuit according to claim 1, wherein said bipolar transistors have n-type epitaxial wells for connecting to a positive supply voltage terminal.

20. The reference voltage circuit according to claim 1, including a voltage divider circuit for multiplying the reference voltage supplied by said bipolar transistor circuit.

* * * * *